US005581622A

United States Patent [19]

Sakurai

[11] Patent Number: 5,581,622

[45] Date of Patent: Dec. 3, 1996

[54] HEAD SET

[75] Inventor: Kazuo Sakurai, Tokyo, Japan

[73] Assignee: Yashima Electric Co., Ltd., Kawaguchi, Japan

[21] Appl. No.: 375,162

[22] Filed: Jan. 18, 1995

Related U.S. Application Data

[63] Continuation of Ser. No. 53,267, filed as PCT/JP92/01093, Aug. 27, 1992, abandoned.

[30] Foreign Application Priority Data

Aug. 29, 1991 [JP] Japan ..... 3-077029

[51] Int. Cl.[6] ..... H04R 25/00

[52] U.S. Cl. ..... 381/183; 381/187

[58] Field of Search ..... 381/183, 187, 381/25, 205, 68.6, 68.7, 68, 69; 379/430, 431; 181/129, 130, 135

[56] References Cited

U.S. PATENT DOCUMENTS

| | | | |
|---|---|---|---|
| 2,485,405 | 10/1949 | Olney et al. | 379/430 |
| 3,781,492 | 12/1973 | Cragg et al. | 379/430 |
| 4,420,657 | 12/1983 | Larkin | 379/430 |
| 4,720,857 | 1/1988 | Burris et al. | 381/187 |
| 4,917,504 | 4/1990 | Scott et al. | 381/187 |
| 5,210,792 | 5/1993 | Kajihara | 381/187 |

FOREIGN PATENT DOCUMENTS

| | | | |
|---|---|---|---|
| 0557384 | 6/1958 | Italy | 381/187 |
| 6316231 | 7/1981 | Japan . | |
| 5631109 | 3/1988 | Japan . | |
| 63-40091 | 3/1988 | Japan . | |
| 63-113392 | 4/1988 | Japan . | |
| 6141320 | 5/1988 | Japan . | |
| 93/05623 | 3/1993 | WIPO . | |

OTHER PUBLICATIONS

Stetomike HMT 808, Dana Vox, Inc., Feb. 8, 1982.

*Primary Examiner*—Curtis Kuntz
*Assistant Examiner*—Huyen D. Le
*Attorney, Agent, or Firm*—Burns, Doane, Swecker & Mathis, L.L.P.

[57] ABSTRACT

The present invention provides a head set capable of improving a sense of comfort when being put on, realizing an easier attaching and detaching operation, and minimizing a feeling of being tired even when used for a long time.

The head set comprises, an auricle insertion type earphone (1) including, an auricle insertion section (4) covered by a cover (3), a casing (5) incorporating an acoustic converter and a cord (6), a supporting member (7) of a rod shape attached on a body (2) of the auricle insertion type earphone, and a microphone (8) arranged in a vicinity of a tip end of the supporting member (7). The microphone (8) is positioned adjacent to a person's mouth or adjacent to an upper portion of the person's cheek.

8 Claims, 4 Drawing Sheets

HEAD SET

This application is a continuation of application Ser. No. 08/053,267, filed Apr. 28, 1993, now abandoned, which is a Continuation-in-Part of International Ser. No. PCT/JP92/01093 filed Aug. 27, 1992.

TECHNICAL FIELD

The present invention relates to a head set, in particular, the present invention relates to a head set capable of improving comfort when being put on and easily attached or detached from a person's head.

BACKGROUND ART

The head set itself has been conventionally used, for example as shown in FIG. 1, where a stopper B is provided on one-end of a head band A formed of an elastic material, and a receiver C is provided on another end thereof, concurrently a microphone E is attached to the receiver C by a supporting rod D. Symbol F depicts an electric cord, a tip end of which is mounted with plugs G and H corresponding to the receiver C and the microphone E respectively.

The conventional head set constructed as described above is used in an arrangement that first the head band A is widened and then the head set is put on a person's head in a manner of pressing the receiver C on one-side ear and the stopper B on an upper portion of the other-side ear, and by adjusting the supporting rod D ordinarily made of a flexible material and rotatably attached on the receiver C, the microphone E is pulled close to the person's mouth to use the head set.

However, the conventional head set which has been used as described above had some drawbacks.

That is, not only the attaching and detaching was troublesome, but the conventional examples was heavy in weight as being constituted of numerous parts members, and further because a head band is used for putting on the person's head, those inevitably give a sense of oppression and annoyance to the person's head portion, which in turn, increases feeling of being tired.

Also, the head sets are in many cases used by women, and those who have actually used the head set pointed out as a problem that the head band pressed on the head portion for a long time would rumple their hairstyle.

An object of the present invention is to provide a head set capable of solving the drawbacks in the technique of the prior art as described above.

DISCLOSURE OF THE INVENTION

To achieve the object described above, the present invention provides a head set characterized by comprising an auricle insertion type earphone, a supporting member of a rod shape attached on the auricle insertion type earphone body, and a microphone arranged adjacent to the tip portion of the supporting member.

BEST MODE FOR CARRYING OUT THE INVENTION

The present invention will now be described with reference to the drawings as follows.

Figure 1:
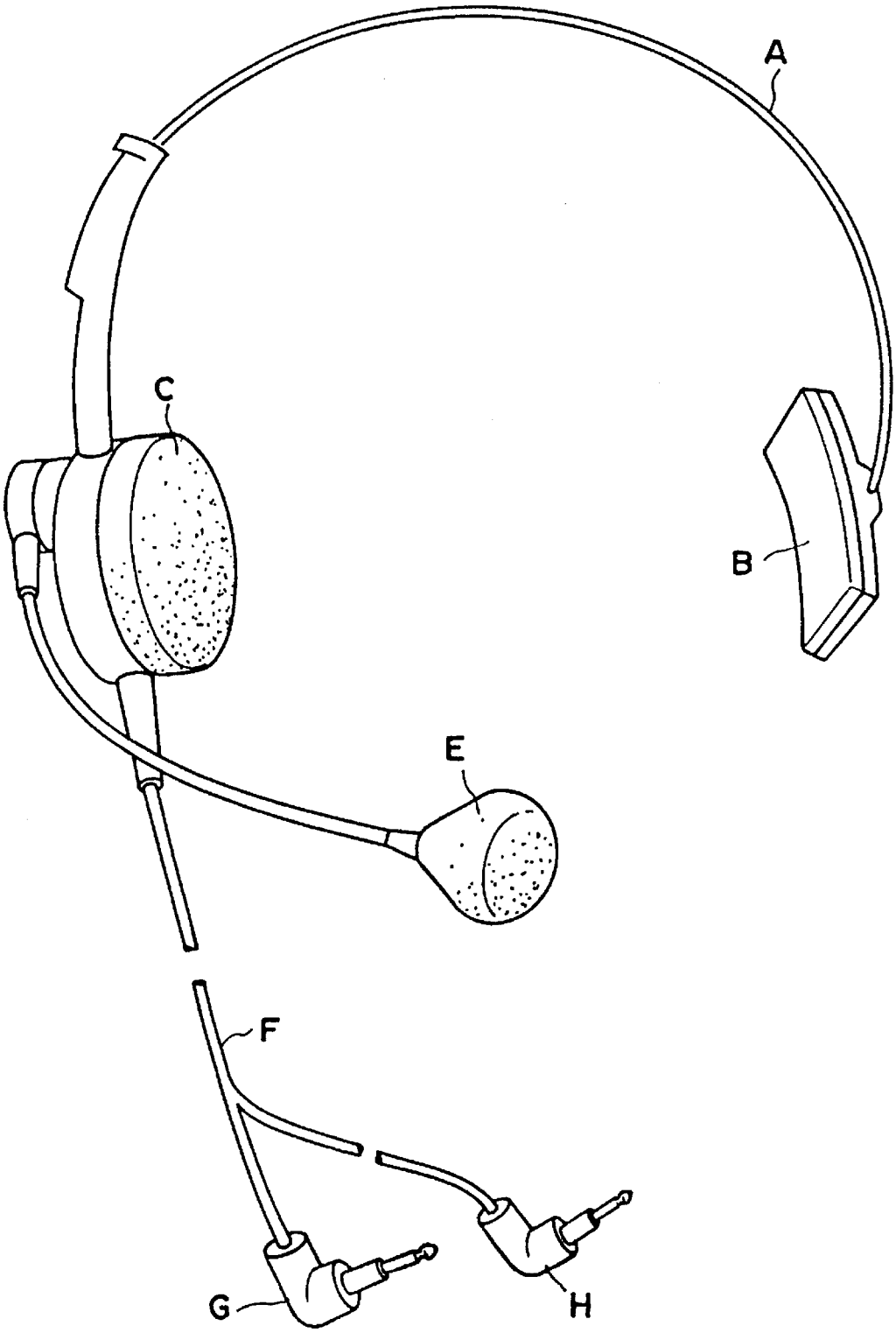
Fig. 1 (PRIOR ART)
FIG. 1 is an front view showing an example of a prior art head set.
Figure 2:
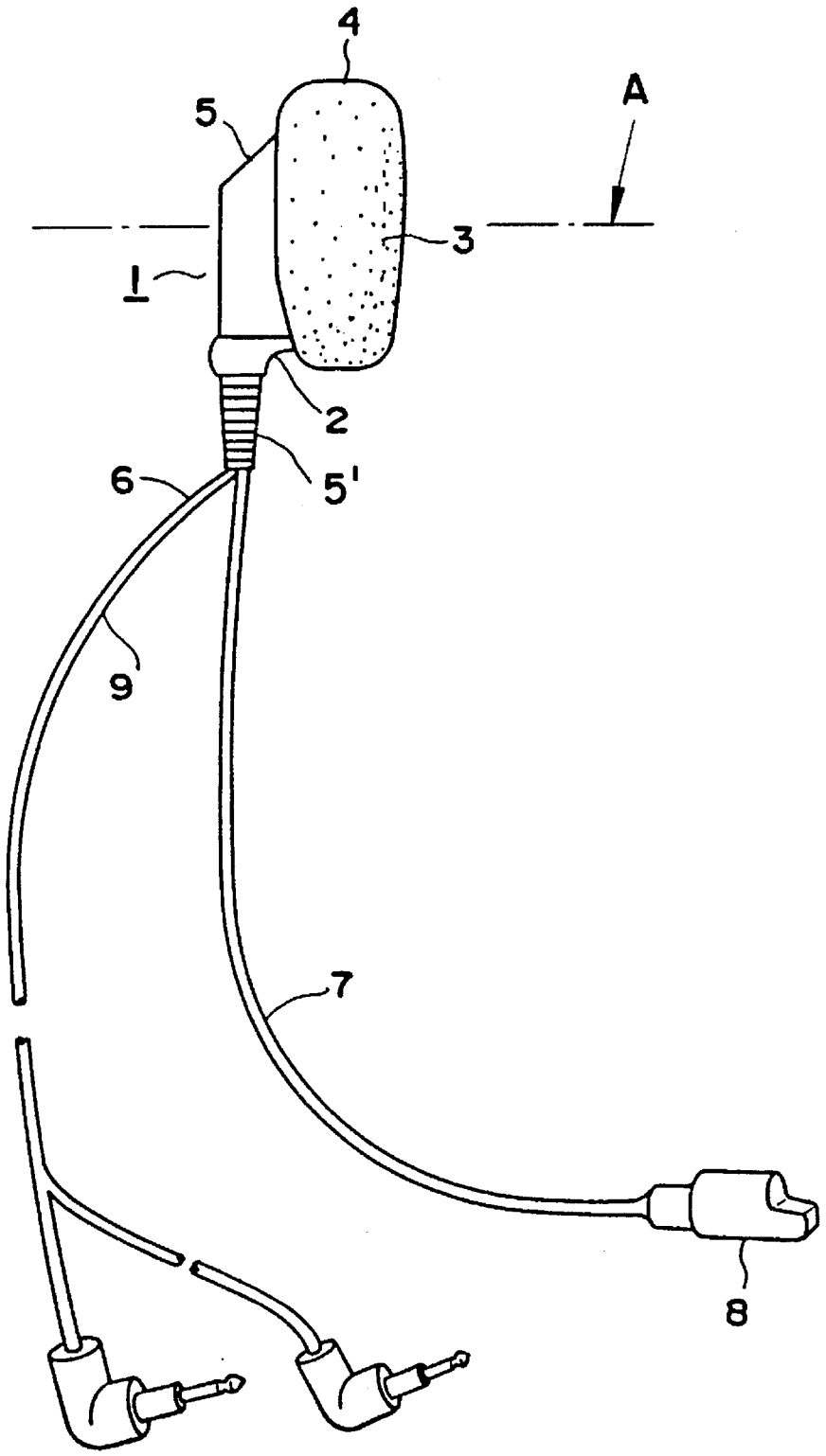
FIG. 2 is an front view showing an example of the embodiment of the present invention.
Figure 3:
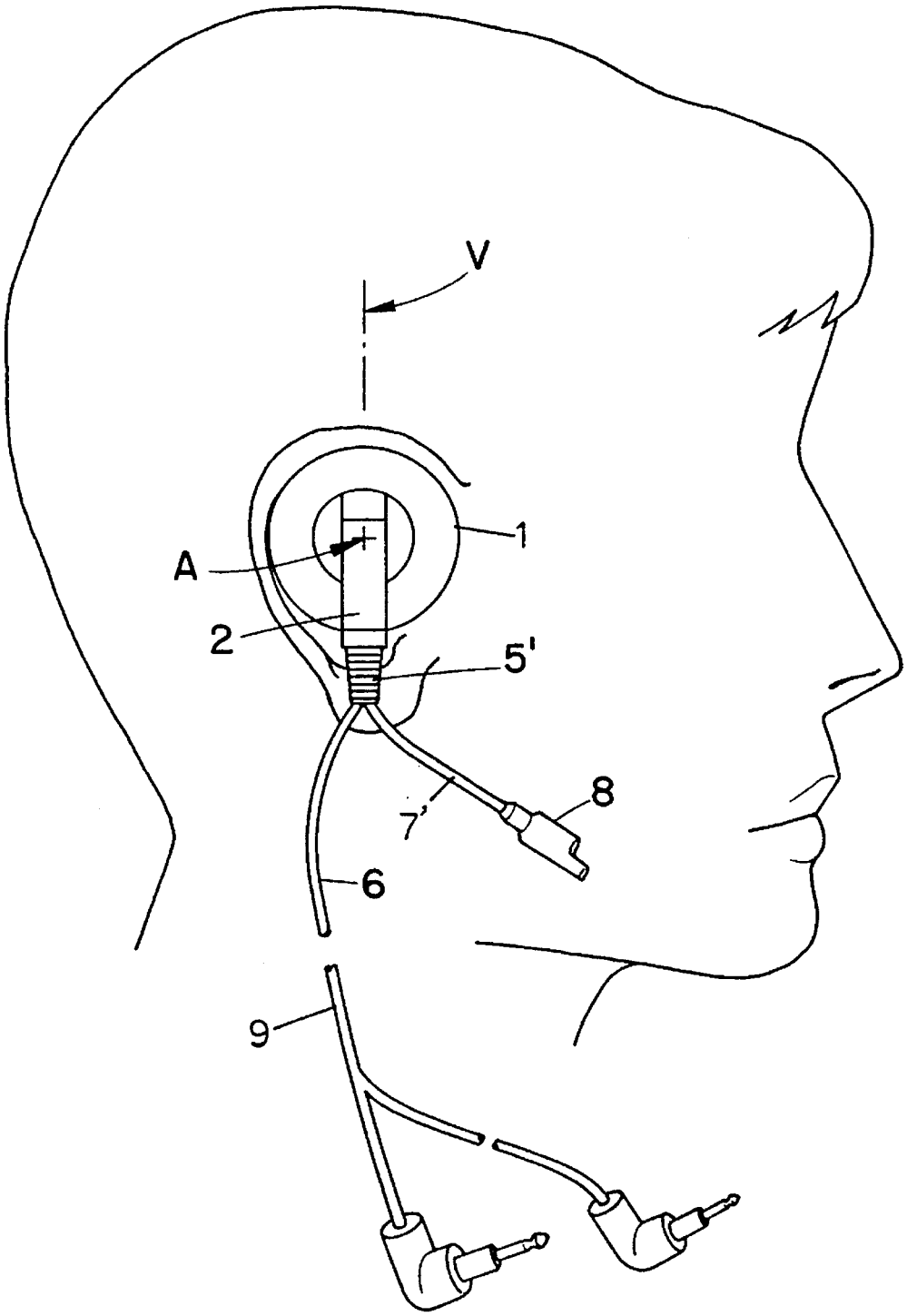
FIG. 3 is a side view showing the other example of the embodiment of the present invention.

FIG. 2 shows an example of the embodiment according to the present invention, where numeral (1) depicts an auricle insertion type earphone, and a body (2) thereof is entirely the same as the auricle insertion type earphone which has conventionally been known. More specifically, the body (2) comprises an auricle inserting portion (4) covered by a cover (3) made of foam rubber and the like as occasion demands and a casing (5) containing an acoustic converter (not shown), wherein an electric signal is supplied from a cord (6) to the acoustic converter within the casing (5) to be converted into sound wave and thereafter to be supplied to the auricle from the auricle inserting portion (4). The body (2) extends vertically downwardly from the auricle insertion portion (4) when the latter is mounted in the wearer's ear, as shown in FIG. 3. According to the present invention, there is no limitation on the shapes and constructions of the auricle insertion type earphones and kinds and the like of the acoustic converters inside thereof.

Numeral (7) depicts a supporting member mounted on the body (2) at a cord outlet portion (5') which is provided extending on a lower portion of the casing (5) in the body (2) of the auricle insertion type earphone, and in this embodiment, the supporting member (7) is formed of a soft metal a surface of which is provided with a cover made of synthetic resin, which shape can freely be changed. The opening of the cord outlet portion (5') extends along a vertical path (V) which intersects a horizontal center axis (A) of the auricle insertion portion (4). According to the present invention, there is no limitation on the material constituting the supporting member (7) and the mounting portion thereof on the body (2). For example, it may be mounted to the casing (5) of the body (2).

Numeral (8) depicts a microphone attached on a tip end-side of the supporting member (7), and a cord (9) extending from the microphone body (not shown) may be exposed as it is, but for obtaining a fine view it may preferably be exposed at the cord outlet portion (5') in a way of passing through the inside of the supporting portion (7), and drawn out with a cord (6). For this microphone, among suitable kinds thereof which can be employed, especially a electret condenser microphone may be preferably used.

To use the head set having the construction described above according to the present invention, as is the case when using a conventionally well known auricle insertion type earphone, the operation proceeds to first insert the body (2) into the auricle, and then by adjusting the supporting member (7), the microphone (8) is positioned in the vicinity of the person's mouth, and the auricle insertion type earphone (1) and the microphone (8) may be electrically connected with the device which must be used.

To facilitate the positioning of the microphone (8) to the vicinity of the person's mouth, the supporting member (7) may be rotatably mounted on the body (2).

A reason why the microphone (8) is provided close to the person's mouth is that, by raising the sound level of a voice and the like from a speaker (a person) to the microphone (8), a sound level of surrounding noise is reduced relative to the microphone (8), considering the case where the head sets are used by a plurality of persons positioned closely with each other.

However on the other hand, because the microphone (8) is adjacent to the person's mouth, not only can it not be denied that a sense of oppression to a certain extent is given to the person, but, breathing from the mouth and nose of the person directly reaches the microphone (8) to produce noise or to generate distortion of sound, for example, a distortion of the sound in an "s" series pronunciations such as phonetic symbols "s", "sh", "ʃ" and "Θ". If the head sets are not used at the same time by a plurality of persons positioning close to each other, reduction of the sound level of the surrounding noise relative to the microphone (8) by positioning the microphone (8) close to the person's mouth and raising the sound level of the person's voice or the like relative to the microphone (8) is not necessitated.

The other example of the present invention shown in FIG. 3 is constituted in view of the consideration described above.

In this embodiment, the same construction as in the embodiment formerly described has been employed except that a supporting member (7') having a shorter length than the supporting member (7) is used, thereby the microphone (8) can be positioned adjacent to a person's cheek, and not adjacent to the person's mouth.

In the other example, depending upon the constructions of the auricle and the auricle insertion type earphone, it may be necessary to provide different constitutions for the right and left ears, however in such a case, similarly to the embodiment described above, the supporting member (7) may be made of flexible material or mounted rotatably on the body.

If one end of the bent-pipe shaped member is made in a shape capable of fitting with a part of the microphone (8) of the supporting member (7') and the other end thereof is made in a sound collecting member formed of a sound collector section by enlarging its diameter to a certain extent, then by using this member, the head set of the other example can be utilized in the same manner as in the case of the head set of the embodiment according to the present invention shown in FIG. 2. This sound collecting member can obtain a larger inertance, therefore it functions also as a filter for cutting a high frequency.

A method of using the other example of the device with the construction according to the present invention as described above is entirely the same as the embodiment described above.

Figure 4:
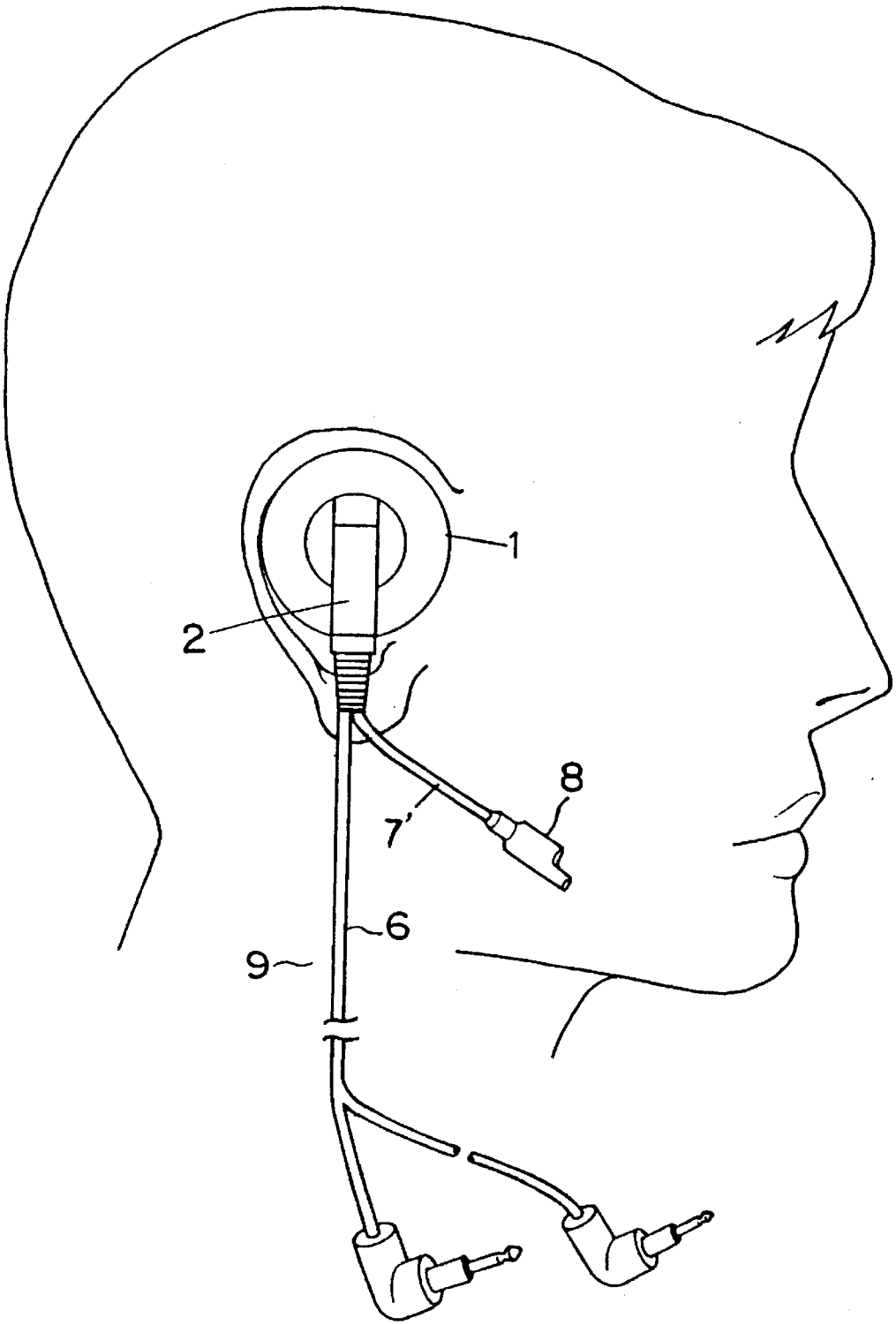
FIG. 4 is a side view showing the other example of the embodiment of the present invention in actual use.

Incidentally, when the other example of the device according to the invention is actually used, the cords (6) and (9) are allowed to hang nearly downward as shown in FIG. 4, so that due to a weight thereof, without any particular countermeasure, the supporting member (7') can be prevented from moving downward as the time lapses. Moreover, a monodirectional microphone may be preferably used to reduce surrounding noise, especially when the shorter supporting member (7') is used.

Industrial Applicability

As herein before fully described, the head set according to the present invention comprises, an auricle insertion type earphone, a supporting member of a rod shape attached on a body of the auricle insertion type earphone, and a microphone arranged in a vicinity of a tip end portion of the supporting member, therefore this provides an easier attaching and detaching operations and furthermore a light weight as a whole, reducing a sense of being tired to the person even when used for a long time.

The head band, which is indispensable in the conventional head set, is not used, therefore hairstyle is not rumpled when used by women.

Furthermore, by using a shorter supporting member, when the microphone is positioned close to the person's cheek but not adjacent to his mouth, not only attaching and detaching operations become easier but because the person using it does not become conscious of the microphone providing with a more comfortable using situation.

Furthermore, in the head set according to the invention, when the supporting member is constructed to be mounted on the body at a cord outlet portion ordinarily formed of soft material, the cord outlet portion acoustically separates the auricle insertion type earphone from the microphone at a tip end of the supporting member by the construction, providing an advantage in eliminating noise and howling.

I claim:

1. A two-way voice communication headset, comprising:

an earphone including a body, and an auricle insertion portion carried by said body and configured for mounting inside of a wearer's ear, said auricle insertion portion defining the sole means of mounting the headset on the wearer, said body configured to extend substantially vertically downwardly from said auricle insertion portion when said auricle insertion portion is mounted in the wearer's ear;

a supporting member connected to said body and extending at an angle relative thereto to extend toward the wearer's cheek when said body extends vertically downwardly, said supporting member terminating in a tip end and being rotatable relative to said body for moving said tip end nearer to, or farther from, a cheek of the wearer;

a microphone mounted at said tip end;

an electric cord extending from said body; and a cord outlet member having first and second ends, said second end having an opening and formed of a soft acoustically insulative material, said body connected to said first end of said outlet member, both said supporting member and said cord extending from said opening of said outlet member.

2. A headset according to claim 1, wherein said auricle insertion portion defines a horizontal center axis, said opening extending along a substantially vertical path intersecting said horizontal center axis.

3. A two-way voice communication headset, comprising:

an earphone including a body, and an auricle insertion portion carried by said body and configured for mounting inside of a wearer's ear, said auricle insertion portion defining the sole means of mounting the headset on the wearer;

a cord outlet member mounted on said body and formed of a soft acoustically insulative material;

a supporting member extending from said cord outlet member, said supporting member terminating in a tip end;

a microphone mounted at said tip end;

an electric cord extending from said cord outlet member; and said cord outlet member having first and second ends, said second end having an opening, said body connected to said first end of said outlet member, both said supporting member and said cord extending from said opening of said outlet member.

4. A two-way voice communication headset according to claim 3, wherein said body is configured to extend substantially vertically downwardly from said auricle insertion portion when said auricle insertion portion is mounted in the wearer's ear, said supporting member extending at an angle relative to said body.

5. A two-way voice communication headset according to claim 3, wherein said supporting member is rotatable relative to said body.

6. A two-way voice communication headset, comprising:

an earphone including a body, and an auricle insertion portion carried by said body and configured for mounting inside of a wearer's ear, said auricle insertion portion defining the sole means of mounting the headset on the wearer, said auricle insertion member defining a horizontal center axis when mounted in the wearer's ear;

a supporting member connected to said body, said supporting member and said body comprising separate elements, said supporting member terminating in a tip end;

a microphone mounted at said tip end;

an electric cord projecting from a cord outlet opening which extends along a substantially vertical path intersecting said horizontal center axis when said auricle insertion portion is mounted in a wearer's ear; and a cord outlet member having first and second ends, said second end having said opening and formed of a soft acoustically insulative material, said body connected to said first end of said outlet member, both said supporting member and said cord extending from said opening of said outlet member.

7. A two-way voice communication headset according to claim 6, wherein said supporting member is rotatable relative to said body.

8. A two-way voice communication headset according to claim 6, wherein said body is configured to extend substantially vertically downwardly from said auricle insertion member when said auricle insertion portion is mounted in the wearer's ear, said supporting member extending at an angle relative to said body.

* * * * *